US006224720B1

(12) United States Patent
Anastasijevic et al.

(10) Patent No.: US 6,224,720 B1
(45) Date of Patent: May 1, 2001

(54) ELECTROLYTIC CELL WITH REMOVABLE BIPOLAR ELECTRODES

(75) Inventors: Nikola Anastasijevic, Altenstadt; Stefan Laibach, Geismar; Dietrich Werner, Messel; Jean-Paul Nepper, Friedrichsdorf; Holger Langschied, Diez; Heinrich Cieslak, Frankfurt am Main, all of (DE)

(73) Assignee: Metallgesellschaft Aktiengesellschaft, Frankfurt am Main (DE)

( * ) Notice: Subject to any disclaimer, the term of this patent is extended or adjusted under 35 U.S.C. 154(b) by 0 days.

(21) Appl. No.: 09/319,362

(22) PCT Filed: Nov. 21, 1997

(86) PCT No.: PCT/EP97/06505

§ 371 Date: Jul. 9, 1999

§ 102(e) Date: Jul. 9, 1999

(87) PCT Pub. No.: WO98/24950

PCT Pub. Date: Jun. 11, 1998

(30) Foreign Application Priority Data

Dec. 4, 1996 (DE) ..... 196 50 228

(51) Int. Cl.[7] ..... C25B 9/00; C25C 7/00; C25D 17/00

(52) U.S. Cl. ..... 204/268; 204/254

(58) Field of Search ..... 204/268, 254, 204/288; 429/210

(56) References Cited

U.S. PATENT DOCUMENTS 4,139,447 * 2/1979 Faron et al. ..... 204/239
5,225,061 * 7/1993 Westerlund ..... 204/254

* cited by examiner

*Primary Examiner*—Kathryn Gorgos
*Assistant Examiner*—Wesley A. Nicolas
(74) *Attorney, Agent, or Firm*—Herbert Dubno

(57) ABSTRACT

An electrolytic cell is disclosed which comprises:

(a) an electrolyte; and (b) a plurality of bipolar electrodes surrounded by the electrolyte and electrically connected in series during operation of the cell, the bipolar electrodes each comprising a cathode side, an anode side, and an electrically conductive connection between the cathode side and the anode side, wherein the cathode side and the anode side of at least one of the bipolar electrodes are movable and mechanically separable with respect to each other so that one of the two electrode sides can be removed from the cell, while the other electrode side remains in the cell.

6 Claims, 2 Drawing Sheets

ELECTROLYTIC CELL WITH REMOVABLE BIPOLAR ELECTRODES

FIELD OF THE INVENTION DESCRIPTION

This invention relates to an electrolytic cell with an electrolyte and a plurality of bipolar electrodes surrounded by the electrolyte, which electrodes are electrically connected in series during the operation of the cell, where each of the bipolar electrodes has a cathode side and an anode side, between which an electrically conductive connection exists during the operation, and where at least one bipolar electrode has a cathode side and an anode side which are designed to be movable with respect to each other.

BACKGROUND OF THE INVENTION

Such cell is known from DE-A-23 55 876, where the cathode side and the anode side are held together by spring elements. The DE-A-44 38 692 (corresponding to U.S. application Ser. No. 08/549,014filed Oct. 27, 1995, now U.S. Pat. No. 5,720,867) and also the U.S. Pat. No. 5,248,398 disclose electrolytic cells by means of which metals are recovered from an electrolyte. What is disadvantageous in the known cells is the fact that each bipolar electrode can only completely be withdrawn from the cell, as the anode side is rigidly connected with the cathode side of the electrode. It is therefore the object underlying the invention to design one or several of the bipolar electrodes such that the desired electrode portion can be handled more or less independent of the other portion.

In the above-mentioned electrolytic cell the object is solved in accordance with the invention in that the bipolar electrode is designed to be separable, and the cathode side or the anode side is designed to be withdrawn from the electrolyte. The cathode side and the anode side are no longer inseparably coupled with each other mechanically, and one of the two electrode sides can be removed from the cell, whereas the other electrode side remains in the cell. One, several or all of the bipolar electrodes of the cell are thus designed to be separable.

SUMMARY OF THE INVENTION

The independent movability of an electrode side as well as the possibility to separate bipolar electrodes in themselves can be utilized in various ways. When the electrolytic cell is used for separating a solid, the solid is deposited on the cathode side or on the anode side during the operation of the cell, depending on the substance and the electrolyte. The electrode side with the deposited product can be withdrawn from the cell independent of the other electrode side, be ensured that the metal is deposited on a bipolar electrode only on the desired surface and not also on another surface of the same bipolar electrode. Metals which are extracted from the electrolyte and are deposited on the cathode side of the bipolar electrodes include for instance copper, zinc, cobalt or nickel. $MnO_2$ can for instance be deposited on the anode side, where a sulfuric-acid manganese(II) sulfate solution is used as electrolyte.

An advantageous aspect consists in that the electric connection between the cathode side and the anode side of the separable bipolar electrode has a touching contact. Through this touching contact an electric current flows during the operation of the cell inside the bipolar electrode between the cathode side and the anode side. Since the two electrode sides only touch each other at the contact and are not screwed together, for instance, the parts can easily be separated from each other mechanically. It is possible to increase the contact pressure of the contact surfaces by means of a clamping effect in the vicinity of the touching contact. In general it is, however, sufficient to utilize the weight of the movable electrode portion for the pressure in the vicinity of the touching contact. A good flow of current in the vicinity of the touching contact is generally ensured in that metals with a good electrical conductivity such as copper or silver touch each other at this point.

The touching contact of two electrode portions may be disposed outside the electrolyte or also in the electrolyte. The touching contact may for instance be disposed on or in the vicinity of the container rim of the cell, where it is easily accessible and can be monitored without difficulties. On the other hand, the touching contact may also be disposed in the electrolyte, e.g. in the vicinity of the bottom of the cell container. In this case, the electrolyte advantageously effects the cooling of the contact area.

The formation of the bipolar electrodes, where the cathode side or the anode side is designed movable and separable, may be effected in various ways. For the anode side there may in particular be used plates of lead, titanium or graphite, and there may also be used activated expanded metal. The anode side may also be designed as gas diffusion anode, where a gas supply is ensured. For the cathode there may likewise be used sheets or plates of e.g. titanium, stainless steel or graphite. The cathode side may have a network or grid structure. It may furthermore be designed as a box with perforated walls, which is filled for instance with carbon granules. A further possibility is to design the cathode side as a gas diffusion cathode and provide for a gas supply.

In the cell, the cathode and anode sides of the electrode may for instance be guided in vertical grooves of the inner walls of the container. Advantageously, it will be ensured that laterally between the inner wall of the container and the electrodes little or no electrolyte is flowing. The distance between the bottom of the container and the lower edge of the electrodes will usually lie in the range between 3 and 30 mm, and the lateral distance between the container wall and the electrodes mostly lies in the range between 0 and 5 mm.

During the metal deposition it is for instance possible by means of the bipolar electrode to specifically limit the area of the deposition in a simple way be merely aligning and influencing the electric field. One possibility of such influence is to provide a partition between the cathode side and the anode side of the separable bipolar electrode. This partition should, however, be designed and arranged such that it does not completely prevent the flow of the electrolyte.

Embodiments of the electrolytic cell and its bipolar electrodes will be explained with reference to the drawing, wherein:

DETAILED DESCRIPTION OF THE DRAWINGS

Figure 1:
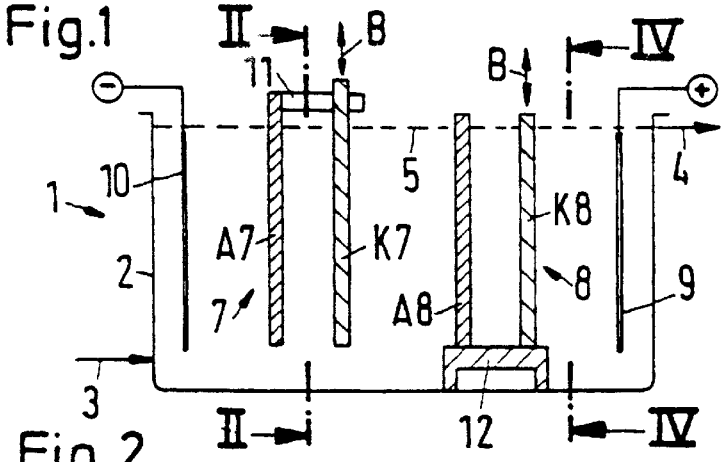
FIG. 1 shows a vertical longitudinal section along line I—I of FIG. 2 through a schematically illustrated electrolytic cell.

The electrolytic cell 1 of FIG. 1 has a trough-like container 2 with an electrolyte inlet 3 and an outlet 4. The liquid level of the electrolyte in the container 2 is marked by the broken line 5. In the container 2 there are disposed a first bipolar electrode 7, a second bipolar electrode 8, a plate-shaped terminal anode 9 and a plate-shaped terminal cathode 10. The main parts of the separable electrode 7 are the cathode side K7 and the anode side A7 as well as the electrically conductive connection 11 between the two electrode sides K7 and A7. The other bipolar electrode 8 has the cathode side K8, the anode side A8 and the electrically conductive connection 12. The anode side A8 and the electrically conductive connection 12 are preferably firmly connected with each other. On the other hand, the cathode side K8 only touches the connection 12 when the cathode side K8, as represented in FIG. 1, is supported on the connection 12 during the operation. Moreover, the cathode side K8 can be moved upwards and can be withdrawn from the container 2 and then be returned to its operating position (FIG. 1), as this is indicated by the double arrow B.

The cathode side (K7) of the bipolar electrode 7 can also be moved upwards (arrow B). In the operating position represented in FIG. 1, the cathode side K7 has been hung into the electrically conductive connection 11, as this will be explained in detail with reference to FIGS. 2 and 3. The connection 11 is preferably firmly connected with the anode side A7, so as to provide a good electrical contact between A7 and 11.

Figure 2:
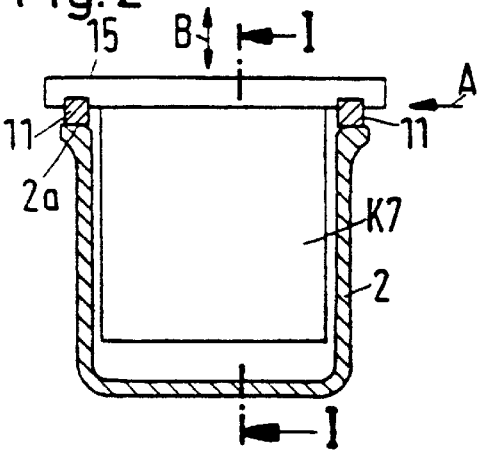
FIG. 2 shows a section along line II—II through the electrolytic cell of FIG. 1.

FIG. 2 shows the vertical cross-section along line II—II through the electrode 7 of FIG. 1. In the container 2 the cathode side K7 is disposed, which is fixed at a horizontal, electrically conductive supporting rod 15. In accordance with FIG. 2, the supporting rod is supported on two electrically conductive connections 11, which are disposed on the upper rim 2*a* of the container 2.

Figure 3:
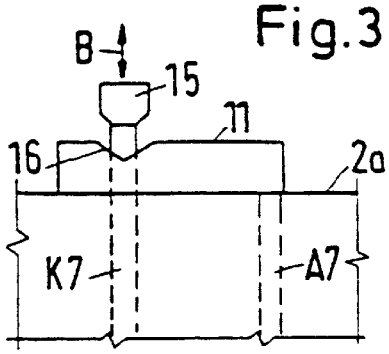
FIG. 3 shows the partial view of a separable bipolar electrode, viewed in the direction of the arrow (A) of FIG. 2.

FIG. 3 shows the view of the representation in accordance with FIG. 2, viewed in the direction of the arrow A. There is shown the upper container rim 2*a,* on which a connection 11 is disposed, which may be connected with the container. What is connected with the electrically conductive connection 11 is the anode side A7 represented in broken lines in FIG. 3. In FIG. 3, contrary to the representation of FIG. 2, the supporting rod 15 is shown slightly lifted off with respect to the connection 11. This should illustrate that the cathode side K7, which is connected with the rod 15, can be removed in upward direction together with this rod. This is indicated by the arrow B. In the operating position, see FIG. 2, the rod 15 lies in a notch 16 in the upper surface of the connection 11. In the vicinity of the notch 16 there is a good electrical contact with the supporting rod 15. At the same time, the notch 16 ensures that upon withdrawal from the container 2 and subsequent re-insertion into the container the cathode side K7 always fits back into the same position. In contrast to the representation of FIG. 2 it may be sufficient to provide only one electrically conductive connection 11 for a bipolar electrode instead of two connections 11. Parts liable to corrosion, such as the supporting rod 15 or the connection 11, may wholly or partly be provided with a titanium shell, which surrounds a copper core with a good electrical conductivity.

Figure 4:
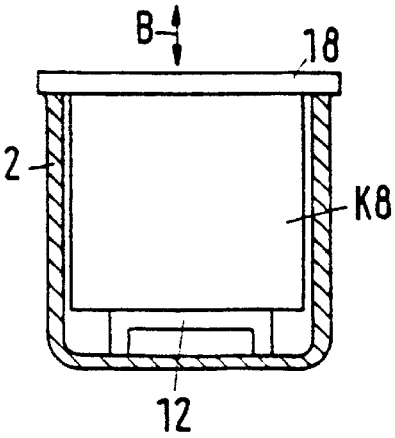
FIG. 4 shows a section along line IV—IV through the electrolytic cell of FIG. 1.

FIG. 4 shows the vertical section along line IV—IV in FIG. 1. In the container 2 the cathode side K8 is shown, which is connected with a horizontal support 18. The support 18 need not be electrically conductive. At the same time, the cathode side K8 is supported on the electrically conductive connection 12, which has a stool-like design. By means of a small, not represented notch in the rim of the container 2 it is ensured that the support is guided only laterally, and the full weight of the cathode side K8 rests on the connection 12.

It is easily possible that, analogous to the way described above and yet to be described with reference to FIGS. 5 and 6, instead of the movable, separable cathode side the anode side of the bipolar electrode is designed movable and separable, and the immovable arrangement is provided for the cathode side.

Figure 5:
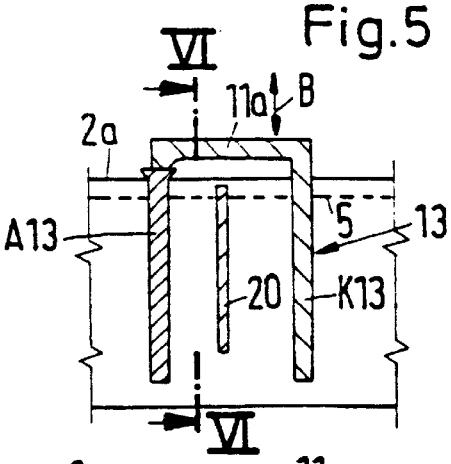
FIG. 5 shows a further variant of a separable, bipolar electrode, represented in a longitudinal section analogous to FIG. 1.
Figure 6:
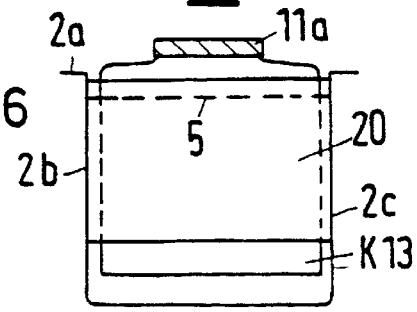
FIG. 6 shows a section along line VI—VI through the electrode of FIG. 5.

FIG. 5 shows a further variant of a separable bipolar electrode 13 in a longitudinal section analogous to FIG. 1; FIG. 6 shows the longitudinal section along line VI—VI of FIG. 5. Above the container rim 2*a* the cathode side K13 has a horizontal connection 11*a,* which in the operating position (see FIG. 5) makes the electrically conductive contact with the anode side A13. FIGS. 5 and 6 additionally show a horizontal partition 20, which is disposed in the vicinity of the electrolyte and is fixed at the side walls 2*b* and 2*c* of the container 2. The upper edge of the partition lies slightly above the liquid level 5. The partition 20 is usually made of a non-conductive material, e.g. plastics. By means of the shape of the partition 20 and furthermore also by means of apertures or perforations disposed in the same, the electric field produced between the cathode side K13 and the anode side A13 can be influenced. The partition focusses the electrical field between the anode side and the cathode side. In particular during the deposition of copper on steel cathodes it is thus possible to ensure that the edge portions of the cathode are fully or largely kept free from deposited copper. During the recovery of zinc, for instance, it is also advantageous when the cathode side, on which the metal is deposited, is free from deposits at the edges. Thus, an unimpeded withdrawal of the cathode side from the electrolyte bath can be ensured.

Figure 7:
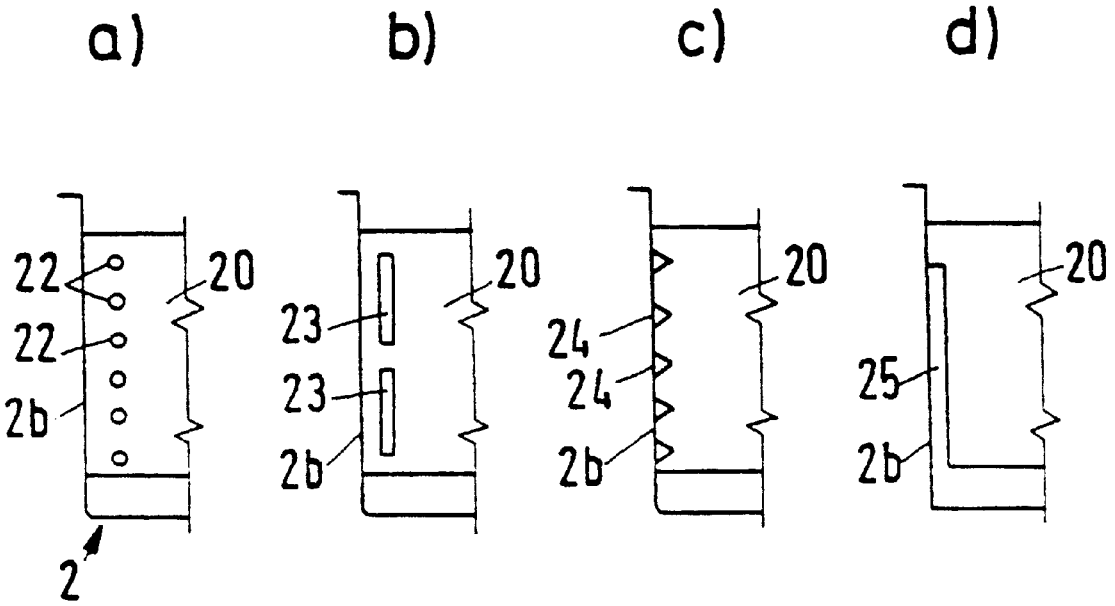
FIG. 7 shows a view of four possibilities of the embodiment of a partition.

FIG. 7 shows the partition 20 in a view with four variants a) to d) of the embodiment of its edge portion. In accordance with FIG. 7*a,* a plurality of apertures 22 are disposed in the partition 20 in the vicinity of the side wall 2*b* of the container 2. Through these apertures the electrolyte and thus the electric field can pass in part and thus in a weakened form through the partition 20. In FIG. 7*b,* the edge portion of the partition is provided with oblong holes 23, in FIG. 7*c* triangular recesses 24 form a serrated edge of the partition 20, and in FIG. 7*d* a narrow gap 25 is provided between the container wall 2*b* and the partition 20, so that a small amount of the electrolyte can pass therethrough. Analogous and symmetrical to the edge portion in the vicinity of the container wall 2*b* the edge portion is formed near the container wall 2*c,* see FIG. 6.

What is claimed is:

1. An electrolytic cell which comprises:

(a) an electrolyte; and (b) a plurality of bipolar electrodes surrounded by the electrolyte and electrically connected in series during operation of the cell, said bipolar electrodes each comprising a cathode side, an anode side, and an electrically conductive connection between said cathode side and said anode side, wherein said cathode side and said anode side of at least one of said bipolar electrodes are movable and mechanically separable with respect to each other so that one of the two electrode sides can be removed from the cell, while the other electrode side remains in the cell.

2. The electrolytic cell defined in claim 1 wherein the electrically conductive connection between the cathode side and the anode side of the movable, mechanically separable bipolar electrode is designed as touching contact which is disposed outside the electrolyte.

3. The electrolytic cell defined in claim 1 wherein the electrically conductive connection between the cathode side and the anode side of the movable, mechanically separable bipolar electrode is designed as touching contact which is disposed in the electrolyte.

4. The electrolytic cell defined in claim 1 wherein the cathode side of the movable, mechanically separable bipolar electrode can be removed from the cell, while the anode side remains in the cell.

5. The electrolytic cell defined in claim 1 wherein the anode side of the movable, mechanically separable bipolar electrode can be removed from the cell, while the cathode side remains in the cell.

6. The electrolytic cell defined in claim 1 wherein the movable, mechanically separable bipolar electrode having a cathode side, an anode side, and an electrically conductive connection between said cathode side and said anode side further comprises a partition disposed between said cathode side and said anode side.

* * * * *